United States Patent [19]

Krenzel

[11] Patent Number: 4,838,396

[45] Date of Patent: Jun. 13, 1989

[54] LUGGAGE HANDLE

[75] Inventor: Ronald L. Krenzel, Boulder, Colo.

[73] Assignee: Delsey Luggage Company, Jessup, Md.

[21] Appl. No.: 219,808

[22] Filed: Jul. 14, 1988

Related U.S. Application Data

[63] Continuation of Ser. No. 23,008, Mar. 6, 1987, abandoned.

[51] Int. Cl.[4] ..... A45C 5/14; A45C 13/26; A45C 13/38

[52] U.S. Cl. ..... 190/18 A; 190/115; 280/37; 280/47.34

[58] Field of Search ..... 190/18 A, 18 R, 115; 16/110 R, 112; 280/37, 47.34

[56] References Cited

U.S. PATENT DOCUMENTS

| | | | |
|---|---|---|---|
| 2,002,836 | 5/1935 | Rossi | 190/18 A X |
| 2,392,926 | 1/1946 | Kelly | 190/18 A X |
| 2,596,578 | 5/1952 | McIntyre et al. | 190/18 A X |
| 3,352,568 | 11/1967 | Ahlf | 280/37 X |
| 3,861,703 | 1/1975 | Gould | 280/47.34 X |

FOREIGN PATENT DOCUMENTS

| | | | |
|---|---|---|---|
| 2510720 | 9/1976 | Fed. Rep. of Germany | 190/18 A |
| 212352 | 3/1924 | United Kingdom | 280/47.34 |
| 2171674 | 9/1986 | United Kingdom | 190/18 A |

*Primary Examiner*—Sue A. Weaver

*Attorney, Agent, or Firm*—Finnegan, Henderson, Farabow, Garrett & Dunner

[57] ABSTRACT

The handle for a luggage case has two end portions and a rigid portion extending substantially across the top side of the case between two ends of the top side when in a first position. One end of the handle is pivotably attached to one end of the top side of the case. The other end of the handle is securable to the other end of the top side of the case. When the handle is in a first position it enables a user to lift and carry the case. The securable end of the handle may also be released and positioned at a substantially greater distance from the case than the other end of the handle for engagement by a user for dragging the case along the ground while allowing the user to maintain a relatively upright position. Wheels attached to the case define a plane along the ground.

13 Claims, 2 Drawing Sheets

LUGGAGE HANDLE

This application is a continuation of application Ser. No. 23,008, filed Mar. 6, 1987, now abandoned.

BACKGROUND OF THE INVENTION

The present invention relates to a luggage handle, and more particularly, a luggage handle arrangement which can be used to either carry or drag a luggage case.

Conventional luggage handle arrangements include C-shaped lift handles which are used to lift and carry a luggage case. In addition, various pull handles have been developed to allow a user to drag the luggage case along the ground while allowing the user to maintain a relatively upright positon. Such conventional handles include flexible straps and rigid rods which are attached to the luggage case and used to pull the luggage case along the ground on two wheels which are attached to one edge of the luggage case so that the luggage case is pulled in an upended fashion like a wheelbarrow.

Such conventional pull handle arrangements have created difficulties in maintaining control over the direction and stability of the luggage case in transport. In addition, conventional arrangements using a rigid handle do not provide an adequate manner in which the handle can be stowed and protected while allowing the handle to be long enough to allow the user to maintain a relatively upright position.

Accordingly, it is an object of the present invention to provide a luggage handle which allows one to maintain control over the direction and stability of a luggage case in transport.

It is another object of the present invention to provide a rigid handle for dragging a luggage case which provides an adequate manner in which the handle can be stowed and protected while allowing the handle to be long enough to allow the user to maintain a relatively upright position.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

This application is related to U.S. patent application Ser. No 07/022,812 for LUGGAGE WHEEL ASSEMBLY by Ronald Louis Krenzel filed concurrently with this application and incorporated herein by reference.

SUMMARY OF THE INVENTION

To achieve the foregoing objects, and in accordance with the purposes of the invention as embodied and broadly described herein, there is provided luggage comprising case means for containing articles and handle means attached to the case means for manual engagement by a user to transport the case means. The handle means includes two end portions and is rigid intermediate the two end portions. The handle means is movably positionable both in a first position in which both end portions of the handle means are positioned relatively proximate to the case means for enabling a user to manually engage the handle means to lift and carry the case means, and in a second position in which one end portion of the handle means is positioned proximate to the case means and the other end portion of the handle means is positioned at a substantially greater distance from the case means for enabling a user to manually engage said other end portion of the handle means to drag the case means along the ground while allowing the user to maintain a relatively upright position.

BRIEF DESCRIPTION OF THE DRAWINGS

The accompanying drawings, which are incorporated in and constitute a part of the specification, illustrate the presently preferred embodiments of the invention and, together with the general description given above and the detailed description of the preferred embodiments given below, serve to explain the principles of the invention.

DESCRIPTION OF THE PREFERRED EMBODIMENT

Reference will now be made in detail to the present preferred embodiments of the invention as illustrated in the accompanying drawings.

In accordance with the present invention there is provided luggage comprising case means for containing articles and handle means attached to the case means for manual engagement by a user to transport the case means. The handle means includes two end portions and is rigid intermediate the two end portions. The handle means is movably positionable both in a first position in which both end portions of the handle means are positioned relatively proximate to the case means for enabling a user to manually engage the handle means to lift and carry the case means, and in a second position in which one end portion of the handle means is positioned proximate to the case means and the other end portion of the handle means is positioned at a substantially greator distance from the case means for enabling a user to manually engage said other end portion of the handle means to drag the case means along the ground while allowing the user to maintain a relatively upright position.

Figure 1:
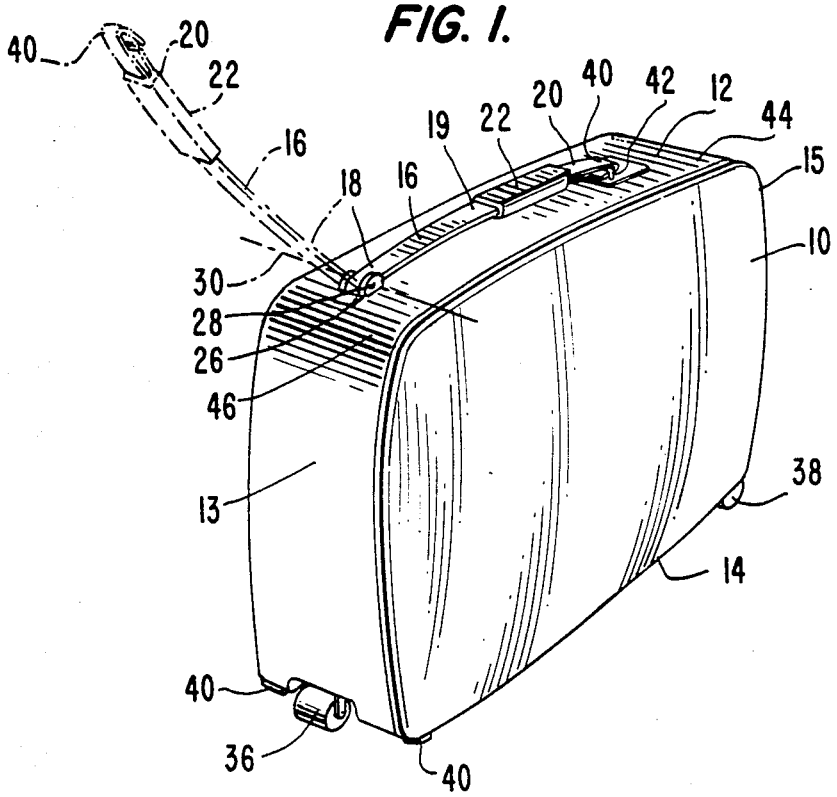
FIG. 1 is a perspective view of a first embodiment of a luggage arrangement incorporating the teachings of the present invention.
Figure 2:
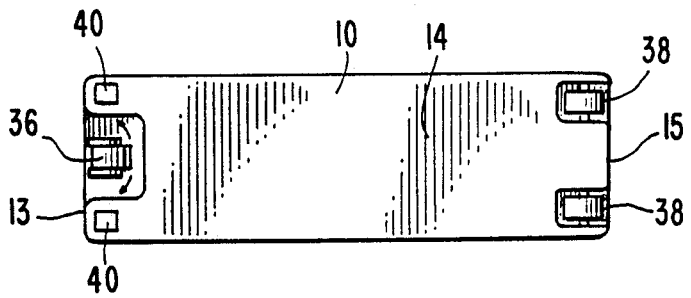
FIG. 2 is a bottom plan view of the arrangement illustrated in FIG. 1.

In accordance with the present invention there is provided luggage comprising case means for containing articles. As shown in FIGS. 1 and 2, the case means includes luggage case 10 which is a right rectangular container. Luggage case 10 has six surfaces including a top side 12 front side 13 bottom side 14 and rear side 15. Case 10 made be opened and closed in any conventional way to allow access to the inside of case 10.

According to the present invention, there is also provided handle means attached to the case means for manual engagement by a user to transport the case means. The handle means has two end portions and is rigid intermediate the two end portions.

As shown in FIG. 1, the handle means includes a handle 16 which is sufficient rigid to maintain its original configuration in all operating positions. Rigid handle 16 is formed as a rigid tube or strip of plastic or metal and includes two end portions 18 and 20 and is rigid intermediate the two end portions. Rigid handle 16 includes a convexly curved middle portion 19 for enabling a user to grasp middle portion 19 when rigid handle 16 is in the position shown in solid lines.

According to the present invention, the handle means is movably positionable in a first position in which both end portions of the handle means are positioned relatively proximate to the case for enabling a user to manually engage the handle means to lift and carry the case means.

As embodied in FIG. 1, the first position of handle means is shown in solid lines. Both end portions 18 and 20 of handle 16 are positioned proximate to case 10 and are attached to case 10. This allows a user to manually engage handle 16 to lift and carry case 10. A grip 22 is positioned on handle 16 at an area around the central portion of top side 12 for user comfort.

According to the present invention, the handle means is movably positionable from the first position to a second position. In the second position, one end portion of the handle means is positioned proximate to the case means and the other end portion of the handle means is positioned at a substantially greater distance from the case means for enabling a user to manually engage said other end portion of the handle means to drag the case means along the ground while allowing the user to maintain a relatively upright position.

As shown in FIG. 1, the second position of handle means is shown in broken lines. One end portion 18 of handle 16 is positioned proximate and affixed to case 10. The other end portion 20 of handle 16 is positioned at a substantially greater distance from case 10 so that it extends upward and outward from top side 12 and front side 13 of case 10. Because end portion 20 of handle 16 is designed to extend sufficiently upward, the user can manually engage end portion 20 without stooping and can maintain a relatively upright position when pulling case 10 along the ground.

In such fashion, handle 16 can be seen to be usable in two positions or two different methods of transporting case 10. The handle 16 has a rigid construction and is connected to case 10 for providing stability and control of case 10 in transport when dragging case 10 along the ground. Handle 16 creates no storage or protection problem when not used in the dragging position because it is secured in position as a handle by which case 10 may be lifted and carried.

It is preferable that the luggage include means attached to said one end of the handle means and the case means for pivoting the handle means about said one end of the handle means. Currently there are two preferred arrangements for the pivoting means. One is a swivel means, and the other is a hinge means.

Figure 3:
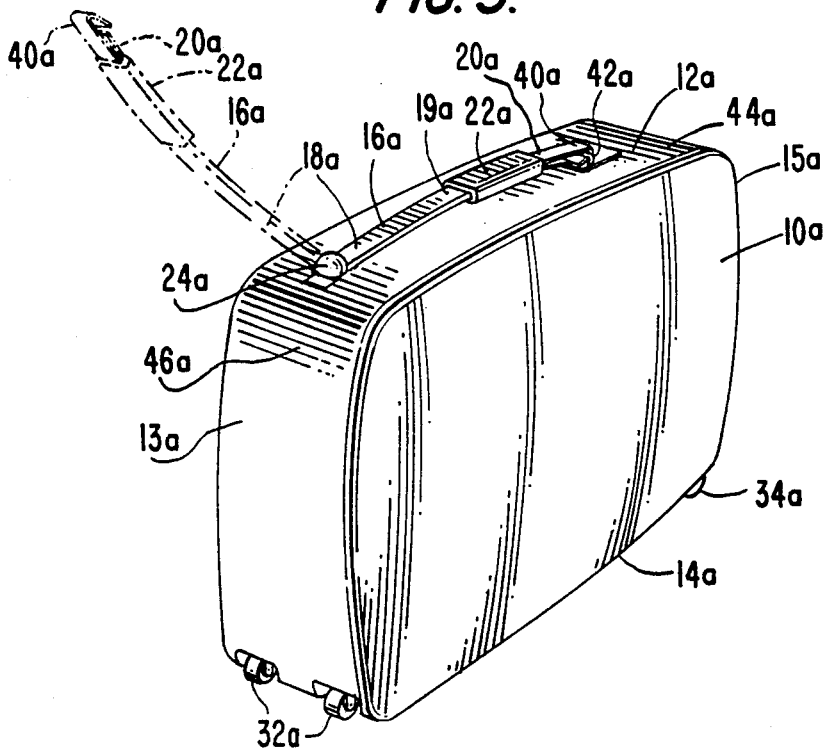
FIG. 3 is a perspective view of another luggage arrangement incorporating the teachings of the present invention.
Figure 7:
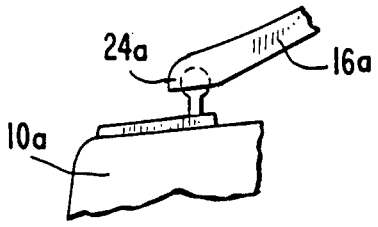
FIG. 7 is an enlarged fragmentary side elevation view of a ball joint illustrated in FIG. 3.

In the arrangement including the swivel means, it is preferable that the pivoting means include swivel means for allowing rotation about the swivel means in more than one rotational degree of freedom, and also that the swivel means comprises a ball joint. As shown in FIGS. 3 and 7, the pivoting means which includes swivel means is a ball joint **24*a* in which one portion of the ball joint is connected to end portion 18*a* and the other part of ball joint 24*a* is affixed to top side 12*a* of case 10*a*. As a result, ball joint 24*a* allows handle 16*a* to move in more than more rotational degree of freedom so that it can move in a front to rear direction as well as in a lateral direction while otherwise maintaining a rigid connection between rigid handle 16*a* and case 10*a***.

In the alternative arrangement in which the pivoting means include hinge means, the hinge means allow rotation about the hinge means in only one horizontal laterally extending axis of rotation when the luggage is oriented so that the handle means is on the top of the case means.

Figure 5:
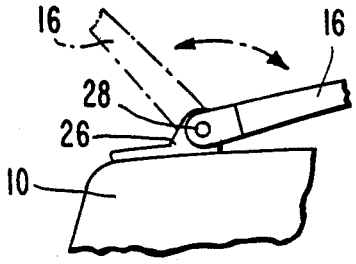
FIG. 5 is an enlarged fragmentary side elevation view of a hinge illustrated in FIG. 1.

As shown in FIGS. 1 and 5, the hinge means include a hinge 26 having a pintle 28 which extends along a horizontal laterally extending axis of rotation 30. One part of hinge 26 is attached to end portion 18 of handle 16, and the other part of hinge 26 is attached to case 10. As a result, rigid handle 16 pivots about horizontal laterally extending axis 30 so that rigid handle 16 can pivot in a front to rear direction while being restrained from pivoting laterally. As a result, this connection between rigid handle 16 and case 10 is even more rigid than the connection shown in FIG. 3, in which the pivot means is a swivel means. As a result, the arrangement shown in FIG. 1 allows the user additional control over the lateral stability of case 10.

Figure 4:
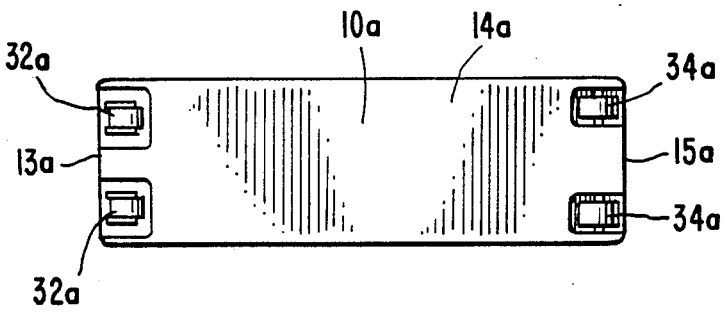
FIG. 4 is a bottom plan view of the arrangement illustrated in FIG. 3.

It is preferable that the luggage include wheel means attached to the case means for enabling the case means to roll on the ground on said wheel means when the handle means is in the second position and when the user drags the case means. As shown in FIGS. 3 and 4, the wheel means include four wheels including two caster wheels **32*a* positioned in the front corners of bottom side 14*a* of case 10*a* and two other wheels 34*a* positioned in the rear corners of bottom side 14*a* of case 10*a***.

For certain applications it may be preferable to have at least four wheels attached to the case means and defining a plane for enabling the case to roll on the ground on said at least four wheels when the handle means is in the second position and when the user drags the case means. As shown in FIGS. 3 and 4, the wheel means include four wheels, wheel pairs **32*a* and 34*a*, in which the bottom surfaces of these wheels define a plane which is coincident with the plane of the ground to enable case 10 to roll on the ground on those four wheels. The rigidity of handle 16*a* and the connection between handle 16*a* and case 10*a* allows sufficient control and stablility of case 10*a*** when dragged by a user so that the four wheels engage the ground during transport.

For certain applications it may be preferable to have three wheels attached to the case means which define a plane for enabling the case means to roll on the ground on said three wheels when the handle means in the second position and when the user drags the case means. It is further preferable that two of the three wheels are positioned at a trailing end of the case means and the third wheel is a caster positioned at a leading end of the case means.

As shown in FIGS. 1 and 2, the three wheels include front wheel 36, which is a caster mounted in the middle of bottom side 14 toward the front side 13 of case 10, and the other two wheels 38 are positioned on the bottom side 14 toward the rear side 15 of the case 10 at corner positions. Skids 40 are positioned at the front corners of the bottom side 14 of case 10 to provide additional lateral stability in the event case 10 tips in a lateral fashion.

It is preferable that the luggage include means for selectively securing the other end portion of the handle means to the case means when the handle means is in the first position and for releasing the other end portion of the handle means from the case means to permit the handle means to be repositioned in the second position.

Figure 6:
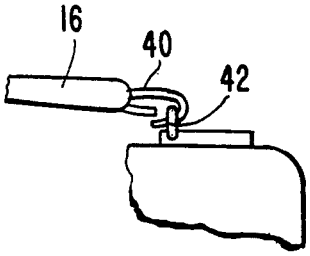
FIG. 6 is an enlarged fragmentary side elevation view of a spring clip and anchor loop illustrated in FIGS. 1 and 3.

As shown in FIGS. 1 and 6, the means for selectively securing the other end portion of the handle means to the case means includes spring clip 40 which is attached to end portion 20 of handle 16, and anchor loop 42 which is affixed to the top surface 12 of case 10. Spring clip 40 snaps into anchor loop 42 to secure it to anchor loop 42 and secure handle 16 to case 10 in the first position shown in solid lines. Spring clip 40 can be opened and released from anchor loop 42 to allow handle 16 to pivot and assume the second position shown in broken lines.

It is preferable that the case means include a top side having two ends and the handle means extend substantially across said top side between the two ends of said top side.

As shown in FIG. 1, the top side of the case means is top side 12 having two ends 44 and 46 proximate to front side 13 and rear side 15. Rigid handle 16 extends substantially across top side 12 between ends 44 and 46 of top side 12. Due to the geometry of the arrangement and the existence of the luggage having various size cases, it to envisioned that larger and longer size luggage may require handle 16 to have a lesser extent relative to the top surface 12 of luggage case 10 than that shown in FIGS. 1 and 3 so that rigid handle 16 is a convenient length for dragging case 10.

Elements shown in the embodiments of FIGS. 3 and 4 having identical numerals to those in the embodiment shown is FIGS. 1 and 2 have structure and function similar to that described in relation to the embodiment shown in FIGS. 1 and 2 but with the suffix "a" added.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the general inventive concept as defined by the appended claims and their equivalents.

What is claimed is:

1. Luggage comprising:

case means for containing articles, the case means including a top side having two ends, a bottom side, a front side facing in a forward direction and a rear side, the case means being longer in the horizontal direction from the front side to the rear side than in the vertical direction from the top side to the bottom side; and handle means having first and second end portions, said handle means being rigid intermediate said first and second end portions; said top side of said case means including a first handle connecting means and a second handle connecting means; said handle means being movably positionable both in a first position in which said first and second end portions of the handle means are attached to said first and second connecting means relatively proximate to the case means for enabling a user to manually engage the handle means to lift and carry the case means, and in a second position in which one end portion of the handle means is attached to said first connecting means proximate to the case means and the other end portion of the handle means is positioned at a substantially greater distance from the case means and forward of the front side for enabling a user to manually engage said other end portion of the handle means to drag the case means in the forward direction along the ground while allowing the user to maintain a relatively upright position.

2. Luggage as claimed in claim 1, wherein said first connecting means includes means for pivoting the handle means about said one end of the handle means.

3. Luggage as claimed in claim 2 wherein said pivoting means includes swivel means for allowing rotation about the swivel means in more than one rotational degree of freedom.

4. Luggage as claimed in claim 3 wherein said swivel means is a ball joint.

5. Luggage as claimed in claim 3 including wheel means having at least four wheels attached to the case means and defining a plane for enabling the case means to roll on the ground on said at least four wheels when the handle means is in the second position and when the user drags the case means.

6. Luggage as claimed in claim 2 wherein said pivoting means includes hinge means for allowing rotation about the hinge means in only one horizontal laterally extending axis of rotation when the luggage is oriented so that the handle means is on top of the case means.

7. Luggage as claimed in claim 6 including wheel means having three wheels attached to the case means and defining a plane for enabling the case means to roll on the ground on said three wheels when the handle means is in the second position and when the user drags the case means.

8. Luggage as claimed in claim 7 wherein two of the three wheels are positioned at a trailing end of the case means and the third wheel is a caster positioned at a leading end of the case means.

9. Luggage as claimed in claim 1 including wheel means attached to the case means for enabling the case means to roll on the ground on said wheel means the handle means is in the second position and when the user drags the case means.

10. Luggage as claimed in claim 1, wherein said second connecting means includes means for selectively securing said other end portion of the handle means to the case means when the handle means is in the first position and for releasing said other end portion of the handle means from the case to permit the handle means to be repositioned in the second position.

11. Luggage as claimed in claim 1 wherein the handle means is generally concavely downward in the first position and generally concavely upward in the second position.

12. Luggage as claimed in claim 1 wherein the handle means extends substantially across said top side between the two ends of said top side when in said first position.

13. Luggage comprising:

case means for containing articles, the case means including a top side having two ends, a bottom side, a front side facing in a forward direction and a rear side, the case means being longer in the horizontal direction from the front side to the rear side than in the vertical direction from the top side to the bottom side;

handle means attached to said case means for manual engagement by a user to transport the case means; said handle means having two end portions and a rigid portion extending substantially across the top side of the case means between the two ends of the top side when in a first position, means pivotably attaching one end portioin of the handle means to one end of the top side of the case means, means selectively securing the other end portion of the handle means to the other end of the top side of the case means, said handle means being movably positionable through said pivotable attachment both in said first position in which both end portions of the handle means are positioned relatively proximate to the case means and said other end portion of the handle means is secured to the other end of the side of the case means for enabling a user to manually engage the handle means to lift and carry the case means, and in a second position in which one end portion of the handle means is positioned proximate to the case means and the other end portion is positioned at a substantially greater distance from the case means and forward of the front side for enabling a user to manually engage said other end portion of the handle means to drag the case means in the forward direction along the ground while allowing the user to maintain a relatively upright position; and wheel means attached to the case means which define a plane along the ground for enabling the case means to roll along the ground when dragged by a user who is in a relatively upright position.

* * * * *